United States Patent [19]

Sinclair

[11] 4,375,880

[45] Mar. 8, 1983

[54] SUPPORT DEVICE AND DISPLAY ASSEMBLY

[75] Inventor: Robert L. Sinclair, Dedham, Mass.

[73] Assignee: General Display, Inc., Medway, Mass.

[21] Appl. No.: 168,431

[22] Filed: Jul. 10, 1980

[51] Int. Cl.[3] ..... E04G 5/06; F16L 3/08

[52] U.S. Cl. ..... 248/225.1; 40/11 R; 248/221.4

[58] Field of Search ..... 248/223.3, 221.4, 221.3, 248/225.1, 205 R; 40/11 R; 24/243 K

[56] References Cited

U.S. PATENT DOCUMENTS

| | | | |
|---|---|---|---|
| 2,927,701 | 3/1960 | Lynde | 40/11 R X |
| 2,983,475 | 5/1961 | Slavsky | 248/221.4 |
| 3,015,177 | 1/1962 | Hembd et al. | 40/11 R X |
| 3,056,572 | 10/1962 | Gelow | 40/11 R X |
| 3,081,568 | 3/1963 | Smith | 40/11 R X |
| 3,228,131 | 1/1966 | Heck | 40/11 R X |
| 3,288,414 | 11/1966 | Fortunato | 248/221.4 |
| 4,179,138 | 12/1979 | Bogdanovic | 248/221.4 X |
| 4,269,381 | 5/1981 | Harms | 248/225.1 X |

*Primary Examiner*—J. Franklin Foss

[57] ABSTRACT

A support device for attachment to a channel member having opposed first and second grooves, the support device including a base portion, first connector structure extending from the base portion in a first direction, and second connector structure extending from the base portion in a second direction, the first and second connector structures being adapted to enter the first and second grooves, respectively, the base portion being adapted to urge the connector structures into seating engagement with their respective grooves.

A display assembly including the above-described support device and channel member.

A display assembly including the above-described support device, channel member, and a copy panel having recesses and tabs adapted for interconnection with the support device and channel member.

4 Claims, 8 Drawing Figures

40
42
44
46
48
32
S
10
34
20
2
12
18'
22
4
36
30
38
8
6
18

40
42
10
46
12
8
36
6
32
30
44
20
18
22
18'
2
38
34
48
4

SUPPORT DEVICE AND DISPLAY ASSEMBLY

BACKGROUND OF THE INVENTION

1. Field of the Invention

The invention relates to support structures for products on display, and is related more particularly to such structures known generally as "shelf extenders".

2. Description of the Prior Art

Shelf extenders are well known in the art and generally comprise structures which are adapted to be attached to existing shelves and provide additional support area for products to be displayed, as for example, in retail stores and the like. Many shelf extenders require attachment to a shelf by means, such as nails or screws, which are less than convenient to attach to, and remove from, a shelf. Further, upon removal of such devices, the shelf is left with nail or screw holes, detracting from the appearance of the shelf.

More recently, it has become commonplace to use metal shelving, which has created a demand for shelf extenders capable of attachment to a shelf without the need of screws or nails. In response to the demand, there have been devised various screw clamp devices wherein the screw serves as a clamping medium and not as an invasive holder, and flat spring steel holders which have flanges that fit into opposed grooves usually provided on the forward edge of shelving used in retail establishments. The screw clamp devices are expensive and require shelf space themselves, interferring with the display. The flat spring steel extenders are also expensive and present difficulties in manufacture inasmuch as the spring steel welds poorly and the heat of welding often destroys or reduces the spring temper of the device. The substitution of plastic for steel has been attempted, but plastic lacks the necessary rigidity and spring strength. In each instance, a single centrally disposed clamp or holder provides minimal lateral stability. The use of two or more such devices in an attempt to solve the stability and/or lack of rigidity problems increases the cost problem.

Accordingly, there is a need for a support device of the shelf-extender type which can be readily connected to, and removed from an existing shelf without the use of nails or screws or other defacing devices, and which is economical to manufacture and which is stable and reliable in use.

SUMMARY OF THE INVENTION

It is, therefore, an object of the present invention to provide a support device for products or the like to be displayed, the support device being adapted for ready connection to, and removal from, an existing shelf.

A further object of the invention is to provide such a device as may be connected to a shelf without the need of nails or screws, or other such invasive connecting devices.

A still further object of the invention is to provide such a device as is relatively simple and economical to manufacture, easy to use, and is stable and reliable in the performance of its function.

Still another object of the invention is to provide a display assembly including the above referred to support device in combination with a channel member fixed to a surface of the shelf, or other support surface.

Another object of the invention is to provide a display assembly including the above referred to support device and channel member in combination with a copy panel having recess and tab means adapted for interconnection with the support device and channel member.

With the above and other objects in view, as will hereinafter appear, a feature of the present invention is the provision of a support device for attachment to a channel member having opposed first and second flange portions defining opposed first and second grooves, the support device comprising an elongated base frame portion, dependent frame portions extending from the base frame portion, first connector means fixed to the base frame portion and extending in a first direction therefrom, and second connector means fixed to the base frame portion and extending in a second direction therefrom, the first connector means being adapted to enter the first groove and abut the first flange portion, and the second connector means being adapted to enter the second groove and abut the second flange portion, the base frame portion being adapted to urge the first connector means into seating engagement in the first groove and the second connector means into seating engagement in the second groove.

In accordance with a further feature of the invention, there is provided a display assembly including the above-described support device in combination with the channel member, the channel member being adapted for attachment to a shelf surface, or other surface.

In accordance with a still further feature of the invention, there is provided a display assembly including the above-described support device and channel member in combination with a copy panel provided with recesses and tabs adapted to interconnect with the support device and channel member.

The above and other features of the invention, including various novel details of construction and combinations of parts, will now be more particularly described with reference to the accompanying drawings and pointed out in the claims. It will be understood that the particular devices embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention from which its novel features and advantages will be apparent.

In the drawings.

DESCRIPTION OF THE PREFERRED EMBODIMENTS

Figure 1:
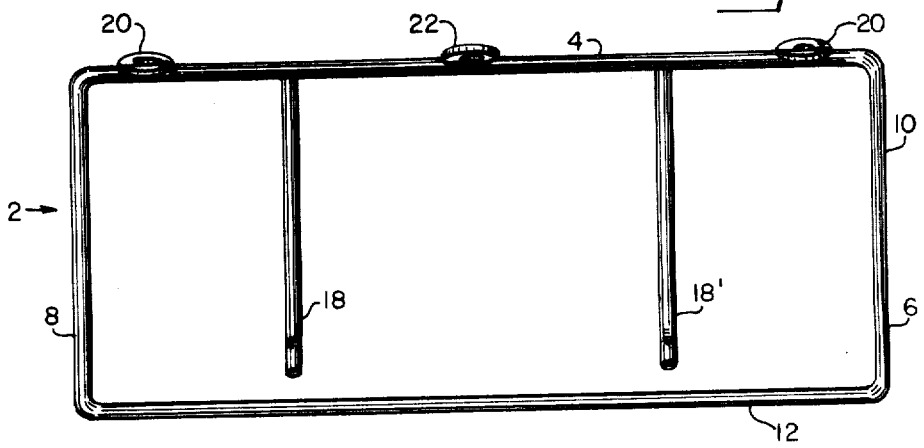
FIG. 1 is a top plan view of a support device illustrative of an embodiment of the invention.

Referring to the drawings, and particularly FIGS. 1-4, it will be seen that the illustrative support device 2 includes an elongated base frame member 4 forming a back portion of a frame assembly 6 including side portions 8, 10 extending from the base frame member 4, and a front portion 12 interconnecting the side portions 8, 10. Additional frame portions 18, 18' depend from the base frame member 4 as desired to accommodate particular products. The base frame member is of leaf spring-like character, preferably of wire construction, as will be further described below. Preferably, the entire frame assembly 6 is of wire construction, rendering the device easy and economical to manufacture.

Figure 2:
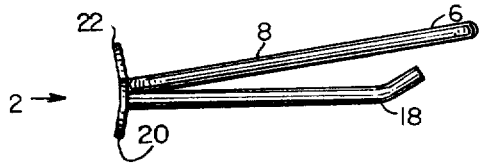
FIG. 2 is a side elevational view thereof.
Figure 3:
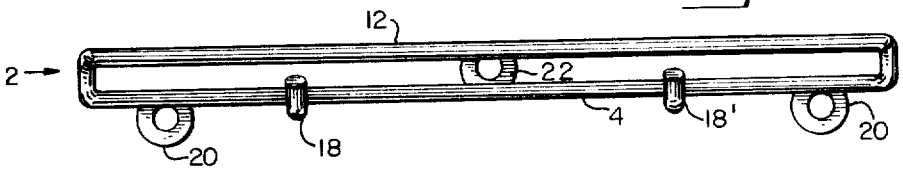
FIG. 3 is a front elevational view thereof.

Fixed to the base frame member 4 are first connector means 20 which extend outwardly from the base frame member 4 in a first direction. In similar fashion, there are fixed to the base frame member 4 second connector means 22, extending outwardly from the base frame member 4 in a second direction. As seen in FIG. 2, the first connector means 20 extend downwardly and somewhat outwardly from the base frame member 4, while the second connector means 22 extend upwardly and outwardly from the base frame member. Thus, while the first and second connector means 20, 22 extend in generally opposite directions, both are angled outwardly from the frame assembly 6. In the illustrated embodiments, the connector means 20, 22 comprise metal washers which are readily available and easily fixed to wire stock. It will be apparent, however, that tabs or other such projections will serve equally well. One of the connector means, for example the first connector means 20, may comprise two washers or projections, each proximate an end of the base frame member 4, and the other of the connector means, for example the second connector means 22, may comprise a single washer or projection disposed centrally of the base frame member. Alternatively, the first connector means may comprise a single centrally-disposed tab, and the second connector means a pair of spaced tabs, the critical point being that the first and second connector means extend in somewhat opposite directions.

Figure 4:
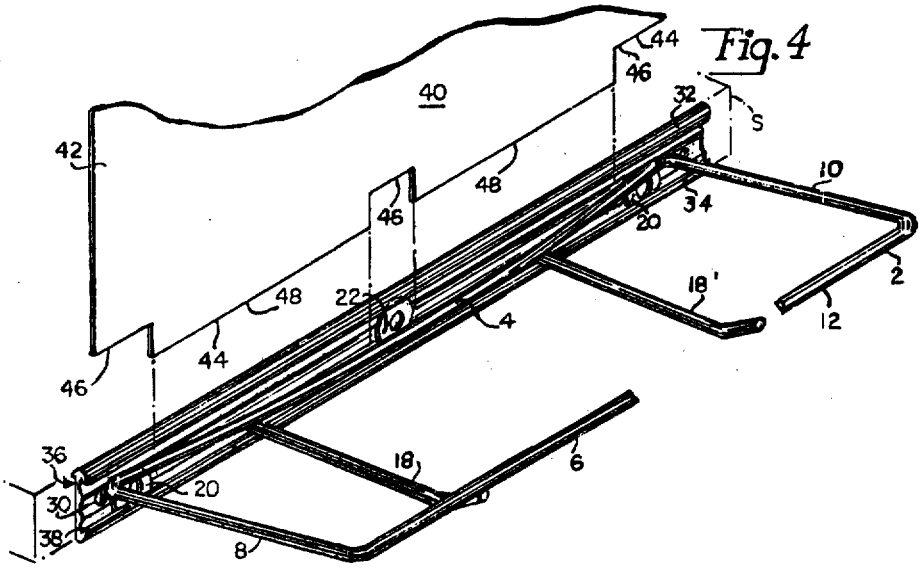
FIG. 4 is a perspective view of the support device of FIGS. 1–3 shown in combination with a channel member and shown, in exploded fashion, in further combination with a copy panel, illustrative of further embodiments of the invention.

Referring to FIG. 4, there will be seen a channel member 30, which is known in the art and is often fixed to a forward edge of a shelf S for the purpose of holding and displaying price cards and the like. The channel member 30 includes first and second flange portions 32, 34 defining opposed first and second grooves 36, 38. The grooves 36, 38 are, in the known and practiced form, adapted to receive the aforementioned price cards for display.

Figure 5:
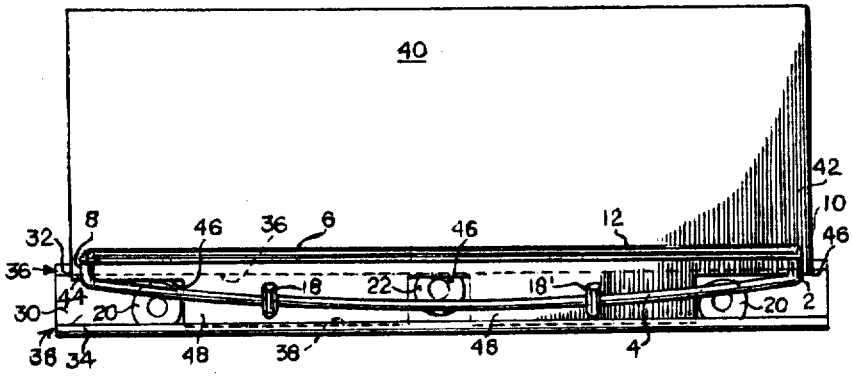
FIG. 5 is a front elevational view of the assembly of FIG. 4, but showing the copy panel in place.

The connector means 20, 22 of the support device 2 are adapted to enter and seat in the grooves 36, 38, the base frame member 4 bending to permit insertion of the connector means in the grooves (FIG. 5). Thus, for shelves equipped with channel members, such as the illustrated channel member 30, the support device affords a ready means for providing additional shelf space without making a permanent attachment to, or defacing, the shelf.

Still referring to FIG. 4, there will be seen a copy panel 40 for use with the support device 2 and the channel member 30 shown. The copy panel 40 includes a base panel 42 for the presentation of information and on one edge 44 thereof a series of recesses 46 and tabs 48, the recesses 46 being adapted to receive the connector means 20, 22, and the tabs 48 being adapted to enter and be retained by the second groove 38 of the channel member 30.

Figure 6:
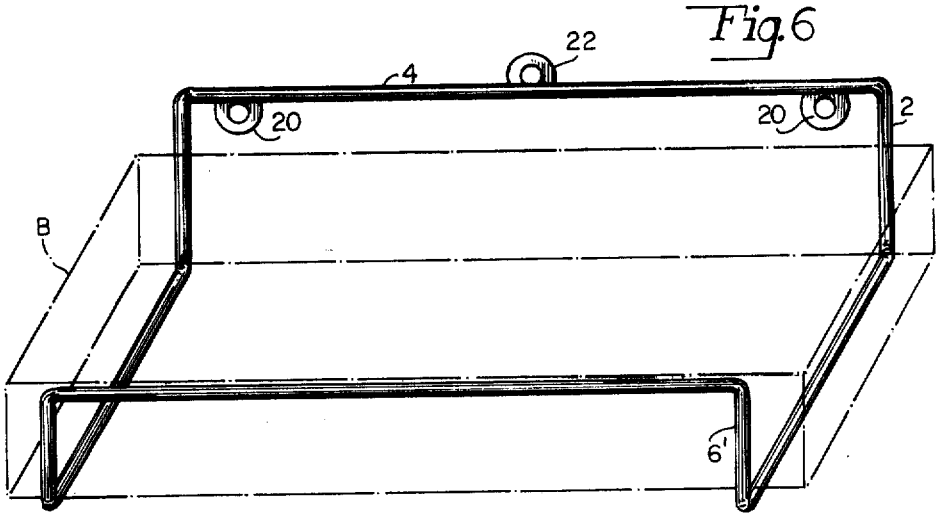
FIGS. 6 and 7 are perspective views of alternative embodiments of the support device.
Figure 7:
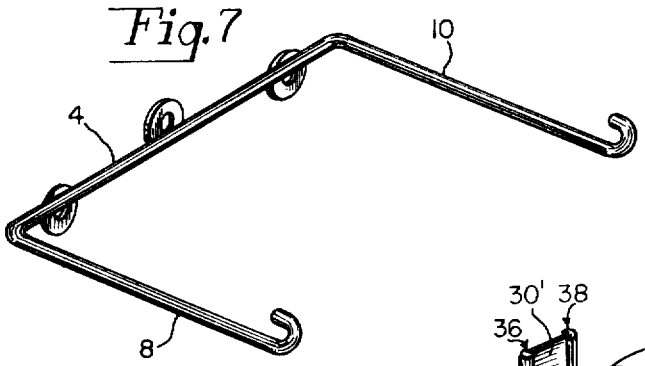

In FIGS. 6 and 7, there are shown alternative embodiments of the support device. In the embodiment shown in FIG. 6, the frame assembly 6' is configured and adapted to receive a box B, or the like. It will be apparent that the frame assembly may be shaped as desired to receive a particular container or receptacle, or to receive a plurality of containers, backing cards, envelopes, or other packaging mediums as well as books, pamphlets, and the like.

In FIG. 7 there is shown a simplified version including the frame member 4 and the side portions 8, 10 extending therefrom. The side portions may be curled at their ends and adapted to receive backing cards with holes therein.

Figure 8:
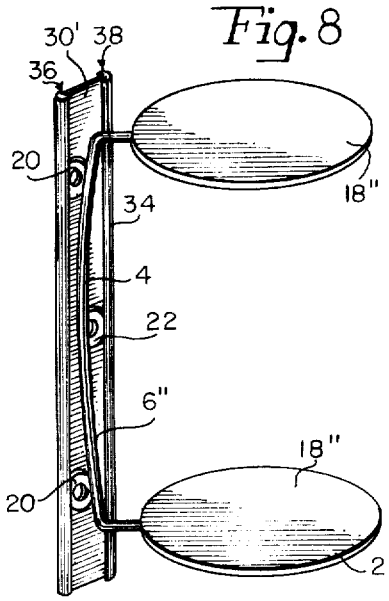
FIG. 8 is a perspective view of an alternative embodiment of a support device and display assembly.

In FIG. 8, there is shown still another embodiment of support device frame assembly 6" adapted to be disposed in a generally vertical position with the dependent frame portions 18" comprising shelf portions extending generally horizontally. In this embodiment, the channel member 30' is disposed vertically.

Referring again to FIG. 4, the support device 2 is used by bending the base frame member 2 to insert the connector means 20, 22 in the opposed grooves 36, 38 of the channel member 30. Upon release of the base frame member 4 by an operator, the leaf spring-like qualities of the base frame member urge the connector means into firm and secure seating engagement in the grooves 36, 38, the connector means being urged into abutting relationship with the flange portions 32, 34. Products may then be placed on the support device, as desired. To remove the support device, the base frame member is deformed to permit extraction of the connector means from the grooves of the channel member. The spring-like base frame member 4 returns to its original unstressed configuration, in condition to be used again. If, in use, the base frame member is flexed beyond the point from which it can completely recover, such does not affect the holding facility of the device, nor its re-use.

It is to be understood that the present invention is by no means limited to the particular construction herein disclosed and/or shown in the drawings, but also comprises any modifications or equivalents within the scope of the disclosure.

Having thus described my invention, what I claim as new and desire to secure by Letters Patent of the United States is:

1. A support device for attachment to a channel member having opposed first and second flange portions defining opposed first and second grooves, said support device comprising an elongated base frame portion, said base frame portion being a substantially straight single strand of wire of sufficient resiliency to comprise a leaf spring, dependent frame portions extending from said base frame portion, first connector means fixed to said base frame portion and comprising first and second projections proximate either end of said base frame portion, respectively, and extending in a first direction therefrom, and second connector means fixed to said base frame portion and comprising a third projection disposed centrally of said base frame portion and extending in a second direction therefrom, said first and second directions being generally opposite, junctures of said first, second and third projections with said base frame portion being in substantial alignment when said device is in an unflexed condition, said first and second projections being adapted, upon flexure of said base frame portion, to enter said first groove and abut said first flange portion, and said third projection being adapted to enter said second groove and abut said second flange portion, said base frame portion being adapted, by virtue of its wire-like leaf spring structure, to urge said first and second projections into seating engagement in said first groove and said third projection into seating engagement in said second groove, said base frame portion being adapted to remain flexed when said projections are in said seating engagements such that in the vicinity of said first and second projections said base frame portion is flexed toward said second flange and in the vicinity of said third projection said base frame portion is flexed toward said first flange, said base frame portion being adapted, upon removal thereof from said channel member, to return to its substantially straight configuration.

2. A display assembly comprising the support device of claim 1 in combination with said channel member, said channel member comprising an elongated strip member having said flange portions defining said grooves, said strip member being adapted for attachment to a planar surface.

3. The invention in accordance with claim 2 and further including a copy panel having along a first edge thereof recesses and tabs, said recesses being adapted to receive said connector means and said tabs being adapted to enter and be retained by a lower of said grooves.

4. The invention in accordance with claim 1 in which said dependent frame portions are configured to receive a container.

* * * * *